United States Patent [19]

Thomsen et al.

[11] Patent Number: 4,465,440

[45] Date of Patent: Aug. 14, 1984

[54] OIL PUMP FOR HAND RAIL CHAIN SAW MACHINES

[75] Inventors: Peter Thomsen, Quickborn; Manfred Mäthner, Hamburg, both of Fed. Rep. of Germany

[73] Assignee: Sachs-Dolmar GmbH, Fed. Rep. of Germany

[21] Appl. No.: 511,694

[22] Filed: Jul. 7, 1983

Related U.S. Application Data

[63] Continuation of Ser. No. 197,295, Oct. 15, 1980, abandoned.

[30] Foreign Application Priority Data

Nov. 9, 1979 [DE] Fed. Rep. of Germany ..... 2945246

[51] Int. Cl.[3] ..... F04B 21/00

[52] U.S. Cl. ..... 417/500; 92/158

[58] Field of Search ..... 92/153, 158; 123/449; 184/27, 33, 35; 417/289, 490, 492, 498, 500

[56] References Cited

U.S. PATENT DOCUMENTS

| | | | |
|---|---|---|---|
| 1,958,395 | 5/1934 | Renfrew | 184/27 R |
| 2,117,474 | 3/1947 | Feroy | 417/490 Y |
| 2,146,184 | 2/1939 | High | 417/500 X |
| 3,118,384 | 1/1964 | Sence et al. | 417/370 |
| 4,231,716 | 11/1980 | Kubota et al. | 417/500 |

FOREIGN PATENT DOCUMENTS

| | | | |
|---|---|---|---|
| 1528391 | 9/1969 | Fed. Rep. of Germany | 417/490 |

*Primary Examiner*—Leonard E. Smith

*Attorney, Agent, or Firm*—Beveridge, DeGrandi & Kline

[57] ABSTRACT

The invention relates to an oil pump for hand rail chain saw machines in which a pump plunger has an annular groove at its end remote from the drive and which is connected via a duct to the pump oil pressure channel, so that the sucking in of secondary air, high wear and an undefined lubrication are avoided.

1 Claim, 1 Drawing Figure

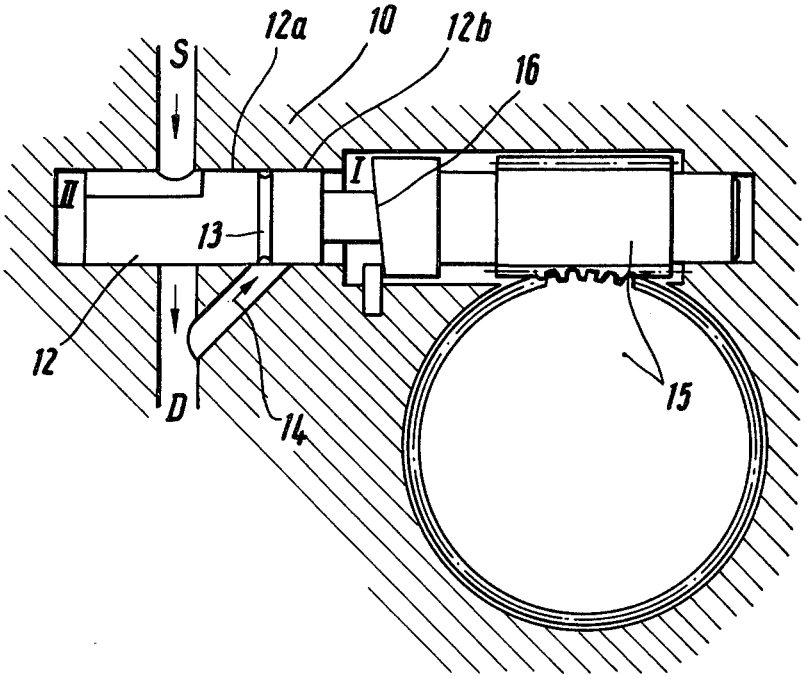
12a
10
12b
16
S
I
II
13
12
D
14
15

OIL PUMP FOR HAND RAIL CHAIN SAW MACHINES

This application is a continuation of application Ser. No. 197,295, filed Oct. 15, 1980, now abandoned.

BACKGROUND OF THE INVENTION

The invention relates to an oil pump with a pump plunger arranged in a pump casing and able to perform lifting movements by means of a drive for hand rail chain saw machines.

Valveless-controlled plunger pumps have been mainly used for the lubrication of the cutting chain in motor saws of the aforementioned type. The pumps are driven by a worm drive or a combined worm-toothed gear drive. As a particularly lightweight, compact construction is required for motor saws, this requirement also applies to the oil pump, although its function must not be impaired.

In connection with this requirement, the sealing of the pump plunger shaft is particularly difficult, because it is very short due to the compact construction and consequently sucks in air via the plunger shaft during the suction phase accompanied by increased suction resistance, either due to cold, i.e. viscous oil or due to contamination of the suction filter. This is prejudicial to the operation of the pump and the contact surface of the plunger and the drive in general becomes generally free from lubricant and is consequently exposed to increased wear.

In the case of the known oil pumps for motor saws, this problem is either unsolved or only partly solved. Known solutions are accurate cylinder fits or seals by O-rings or long plungers.

All these solutions have the disadvantage that they are not free from wear and do not ensure an adequate lubrication of the drive.

BRIEF SUMMARY OF THE INVENTION

The problem of the present invention is to provide an oil pump for hand rail chain saw machines, which obviates the aforementioned deficiencies with respect to such machines such as the sucking in of secondary air, wear and not precisely defined lubrication.

According to the invention, this problem is solved by a pump of the aforementioned type constructed in such a way that at its end remote from the drive the pump plunger has an annular groove connected to the pump oil pressure channel via a duct.

As the annular groove provided on the plunger shaft is subject to the action of the medium from the pressure side and is sealed with the medium supplied, an adequate lubrication for the drive is ensured and wear to its most important parts is prevented. As the annular groove is under system pressure, by means of the clearance between the pump plunger and the pump cylinder a clearly defined waste oil quantity is supplied which is used for lubricating the drive.

The advantages resulting from the novel construction of the oil pump are in particular that the pump can be kept small without its function being impaired. A further advantage is that a clearly defined lubrication of the drive, i.e. the defined waste oil quantity can be ensured. The invention also provides the advantage that in operation the pump plunger is continuously wetted with an oil film and forced lubrication takes place with rising operating pressure. It is also extremely advantageous that no moving parts, i.e. parts subject to wear, are required for sealing and lubrication.

DESCRIPTION OF THE DRAWING AND PREFERRED EMBODIMENT

The invention is described in greater detail hereinafter relative to a non-limitative embodiment and the attached drawing which shows a cross-section through an oil pump with a pressure seal.

In the drawing, 10 is a pump casing in which a pump plunger 12 performs a lifting movement. In the case of the embodiment shown in the drawing, the lifting movement is produced by a worm gear 15 and a lifting cam 16.

To prevent a penetration of secondary air during the suction phase from chamber 1 via cylinder faces **12*a* and 12*b* into cylinder chamber II, an annular groove 13 is formed in the pump plunger 12 connected via a cross-bore 14** with the oil pressure channel D. The oil suction channel is indicated at S.

What is claimed is:

1. An oil pump comprising:

a pump housing having a cylinder therein and having an oil suction channel and an oil pressure channel, each communicating with said cylinder, and a cross channel coupling said cylinder with said oil pressure channel;

a pump piston positioned for substantially continuous reciprocation within said cylinder and having an annular groove in the side surface thereof located longitudinally on said pump piston to pass across said cross channel and to move a distance within said cylinder on each side of said cross channel as said pump piston reciprocates in said cylinder to carry fluid from said oil pressure channel into said cylinder and distribute such fluid over the interior of said cylinder to lubricate said piston and said cylinder and to provide a seal to prevent penetration of air into said cylinder during operation; and a drive unit for causing said pump piston to reciprocate substantially continuously within said cylinder as said drive unit operates.

* * * * *